US009435079B2

(12) United States Patent
Oswald et al.

(10) Patent No.: US 9,435,079 B2
(45) **Date of Patent: *Sep. 6, 2016**

(54) UNCOATED RECORDING MEDIA

(75) Inventors: Thomas Roger Oswald, Eagle, ID (US); John L. Stoffel, San Diego, CA (US); George B. Clifton, Boise, ID (US); Robert J. Lawton, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/389,867

(22) PCT Filed: May 25, 2012

(86) PCT No.: PCT/US2012/039758

§ 371 (c)(1),
(2), (4) Date: Oct. 1, 2014

(87) PCT Pub. No.: WO2013/176682

PCT Pub. Date: Nov. 28, 2013

(65) Prior Publication Data

US 2015/0062236 A1 Mar. 5, 2015

(51) Int. Cl.

| | |
|---|---|
| ***D21H 11/08*** | (2006.01) |
| ***D21H 17/00*** | (2006.01) |
| ***D21H 11/00*** | (2006.01) |
| ***D21H 17/67*** | (2006.01) |
| ***D21H 17/68*** | (2006.01) |
| ***B41M 5/50*** | (2006.01) |

(Continued)

(52) U.S. Cl.

CPC ..... *D21H 17/73* (2013.01); *B41M 5/50* (2013.01); *D21H 11/00* (2013.01); *D21H 11/02* (2013.01); *D21H 11/10* (2013.01); *D21H 17/66* (2013.01); *D21H 17/67* (2013.01); *D21H 17/675* (2013.01); *D21H 17/68* (2013.01); *B41M 5/0035* (2013.01); *B41M 5/0047* (2013.01); *D21H 11/08* (2013.01); *D21H 17/63* (2013.01); *D21H 27/00* (2013.01)

(58) Field of Classification Search

CPC ..... D21H 27/00; D21H 11/08; D21H 11/10; D21H 17/63; D21H 17/66; D21H 17/675; B41M 5/0035; B41M 5/0047

See application file for complete search history.

(56) References Cited

U.S. PATENT DOCUMENTS

| | | | |
|---|---|---|---|
| 3,556,934 | A | 1/1971 | Meyer |
| 3,779,951 | A | 12/1973 | Streu |

(Continued)

FOREIGN PATENT DOCUMENTS

| | | |
|---|---|---|
| CN | 1455047 | 11/2003 |
| CN | 1580395 | 2/2005 |

(Continued)

*Primary Examiner* — Betelhem Shewareged

(74) *Attorney, Agent, or Firm* — Dierker & Kavanaugh, P.C.

(57) ABSTRACT

An uncoated recording medium includes a blend of hardwood fibers and softwood fibers. The total fiber content is at least 80 wt % of a total wt % of the uncoated recording medium. A filler is present in the uncoated recording medium in an amount ranging from about 3 wt % to about 10.2 wt % of the total wt % of the uncoated recording medium. The uncoated recording medium has i) a weight ranging from about 50 g/m$^2$ to about 70 g/m$^2$, and ii) a machine direction Lorentezen & Wetter 5 degree bending stiffness ranging from about 0.19 mNm to about 0.27 mNm and a cross direction Lorentezen & Wetter 5 degree bending stiffness ranging from about 0.09 mNm to about 0.12 mNm, and iii) an ISO brightness of at least 86.

17 Claims, 3 Drawing Sheets

(51) Int. Cl.

| | |
|---|---|
| ***D21H 11/02*** | (2006.01) |
| ***D21H 11/10*** | (2006.01) |
| ***D21H 17/66*** | (2006.01) |
| *D21H 17/63* | (2006.01) |
| *D21H 27/00* | (2006.01) |
| *B41M 5/00* | (2006.01) |

(56) References Cited

U.S. PATENT DOCUMENTS

| | | | |
|---|---|---|---|
| 3,884,685 | A | 5/1975 | Green, Jr. et al. |
| 4,952,278 | A | 8/1990 | Gregory et al. |
| 6,436,238 | B1 | 8/2002 | Pitkanen et al. |
| 6,480,298 | B1 | 11/2002 | Sullivan |
| 6,669,814 | B2 | 12/2003 | Hansen et al. |
| 6,937,358 | B2 | 8/2005 | Sullivan et al. |
| 7,037,405 | B2 | 5/2006 | Nguyen et al. |
| 7,482,046 | B2 | 1/2009 | Williams et al. |
| 7,497,924 | B2 | 3/2009 | Nguyen et al. |
| 8,012,312 | B2 | 9/2011 | Goto et al. |
| 2002/0182376 | A1 | 12/2002 | Mukherjee et al. |
| 2003/0234846 | A1 | 12/2003 | Koga et al. |
| 2004/0043200 | A1 | 3/2004 | Masek |
| 2004/0180184 | A1* | 9/2004 | Fillion et al. ..... 428/211.1 |
| 2004/0241348 | A1 | 12/2004 | Koga et al. |
| 2004/0256067 | A1 | 12/2004 | Leskela et al. |
| 2005/0148260 | A1* | 7/2005 | Kopacz et al. ..... 442/381 |
| 2005/0155520 | A1 | 7/2005 | Van Der Horst |
| 2006/0260775 | A1 | 11/2006 | Sammarco et al. |
| 2007/0087138 | A1 | 4/2007 | Koenig et al. |
| 2008/0226849 | A1 | 9/2008 | Matsuda et al. |
| 2009/0236063 | A1 | 9/2009 | Onozuka et al. |
| 2009/0320708 | A1* | 12/2009 | Jackson et al. ..... 101/483 |
| 2010/0163198 | A1 | 7/2010 | Dougherty |
| 2011/0088862 | A1 | 4/2011 | Esko et al. |
| 2013/0224450 | A1* | 8/2013 | Wingkono et al. ..... 428/206 |

FOREIGN PATENT DOCUMENTS

| | | |
|---|---|---|
| CN | 101265680 | 9/2008 |
| WO | WO-93/22499 | 11/1993 |
| WO | WO-2006067273 | 6/2006 |
| WO | WO-2010044795 A1 | 4/2010 |

* cited by examiner

UNCOATED RECORDING MEDIA

BACKGROUND

Media used in laser printing and in inkjet printing often have a weight ranging from about 75 g/m$^2$ (gsm) to about 90 g/m$^2$ (gsm). Media within this weight range may be desirable for laser printing at least in part because of the opacity characteristics exhibited by the media, as well as the printing performance that is achieved with the media in terms of reduced or eliminated wrinkling and jamming. Media having a weight within the weight range provided above may also be desirable for inkjet printing, at least in part because show through (i.e., strikethrough) is minimized or eliminated.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
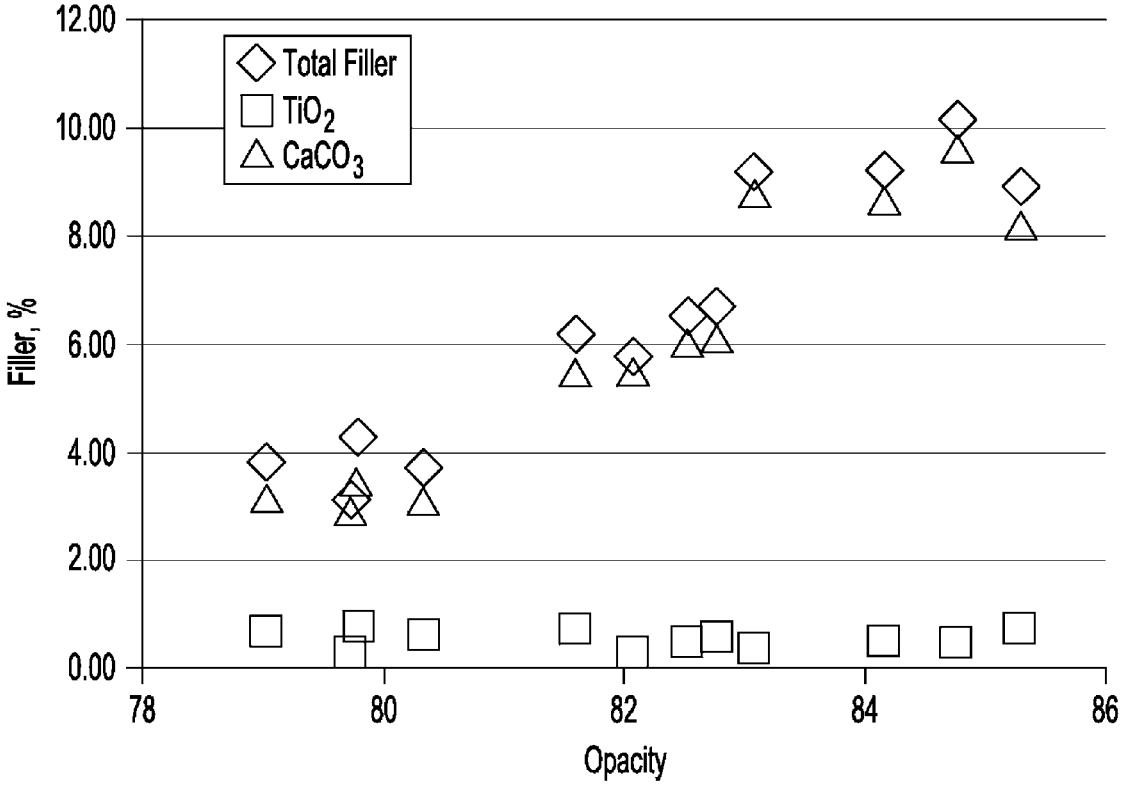
FIG. 1 is a graph illustrating opacity versus filler percentage for samples 1 through 12 of Example 2.

The present disclosure relates generally to uncoated recording media. Examples of the uncoated recording medium disclosed herein are thin papers, which have a weight ranging from about 50 g/m$^2$ (gsm) to about 70 g/m$^2$ (gsm). In some instances, the weight ranges from about 50 gsm to about 63 gsm. In examples of the media disclosed herein, a balance between fiber amount and filler amount has been identified so that the filler amount is reduced without deleteriously affecting desirable qualities, such as weight, stiffness, opacity, and brightness. In fact, the stiffness of the examples of the media disclosed herein contributes to the thin paper working reliably in a variety of printing systems, including laser printers and inkjet printers. It is believed that the runability of the thin papers disclosed herein is enhanced. For example, it is believed that the thin papers will exhibit reduced or eliminated jamming and wrinkling when compared to other commercially available thin papers. Some examples of the uncoated recording media disclosed herein are also particularly suitable for use in inkjet printing systems. These examples of the thin paper are able to maintain inkjet colorants on the surface and thus exhibit minimal show through, which is desirable.

The examples of the uncoated recording media disclosed herein may be about 20% thinner and lighter than other commercially available papers (e.g., 16 lbs compared to 20 lbs). The thin and light-weight examples disclosed herein offer many advantages. For example, fewer raw materials are utilized to manufacture the thin paper, and the lighter weight of the thin paper may result in lower shipping costs of the paper itself and of brochures and other products made with the paper. Furthermore, thinner paper requires less storage space than thicker paper in cabinets, printer paper trays, briefcases, etc. In addition, laser printers may utilize less power for fusing toner on thinner paper.

Examples of the uncoated recording medium (i.e., thin paper) include a blend of hardwood fibers and softwood fibers. Examples of suitable hardwood fibers include pulp fibers derived from deciduous trees (angiosperms), such as birch, aspen, oak, beech, maple, and eucalyptus. Examples of suitable softwood fibers include pulp fibers derived from coniferous trees (gymnosperms), such as varieties of fir, spruce, and pine (e.g., loblolly pine, slash pine, Colorado spruce, balsam fir, and Douglas fir). In an example, the uncoated recording medium includes a blend of International Paper northern USA hardwood fibers and International Paper southern USA softwood fibers. In an example, the ratio of hardwood fibers to softwood fibers used ranges from about 70/30 to about 60/40.

The uncoated recording medium has a total fiber content of at least about 80 wt % of the total wt % of the uncoated recording medium. "Wt %" as used herein refers to dry weight percentage based on the total dry weight of the uncoated recording medium. The total fiber content is equal to 100 wt % minus total filler wt % minus wt % of any other ingredients, including, for example, sizing agents, starch, and salt. In an example, the total fiber content ranges from about 85 wt % to about 92 wt %.

The blend of hardwood and softwood fibers may be prepared via any known pulping process, such as, for example, chemical pulping processes. In an example, the hardwood and softwood fibers are chemically pulped fibers. Two suitable chemical pulping methods include the kraft process and the sulphite process. In another example, some of the hardwood and softwood fibers are chemically pulped fibers and some of the hardwood and softwood fibers are mechanically pulped fibers. In the latter example, the amount of chemically pulped fibers is at least 90 wt % of the total fiber content, and the amount of mechanically pulped fibers is up to 10 wt % of the total fiber content.

It is to be understood that the hardwood and softwood fibers used in the examples disclosed herein are not expanded fibers, and the uncoated recording medium does not include any expanded fibers. Expanded fibers are hardwood and/or softwood fibers that have been exposed to a treatment process that expands the fibers. Expanded fibers exhibit a gel-like resistance to settling. One example of a treatment process that forms expanded fibers utilizes a horizontal fine media mill having a 1.5 liter fibrillating zone volume and five impellers. Expanded fibers can be added to increase the strength of the resulting media; however, the thin paper disclosed herein exhibits a desirable stiffness without the inclusion of expanded fibers.

The uncoated recording medium also includes the filler. As mentioned above, the ratio of fiber to filler has been selected to achieve the examples of the thin paper disclosed herein, which have desirable stiffness and opacity. In general, the amount of fiber has been increased, and the amount of filler has been reduced. In an example, the amount of filler included in the uncoated recording medium ranges from about 3 wt % to about 10.2 wt % of the total wt % of the uncoated recording medium. In some examples disclosed herein, the uncoated recording medium may include from about 60 lbs of filler per ton of paper to about 200 lbs of filler per ton of paper (i.e., from about 27 kg of filler per ton of paper to about 91 kg per ton of paper).

In an example, the uncoated recording medium includes a 70/30 blend of fibers and at least 6.2 wt % filler(s) to render a thin paper that is light weight, has the desirable opacity, and has the desirable stiffness (i.e., exhibits desirable runnability on printers).

Examples of suitable fillers include titanium dioxide ($TiO_2$), precipitated calcium carbonate, ground calcium carbonate, talc, clay (e.g., calcined clay, kaolin clay, or other phyllosilicates), calcium sulfate, or combinations thereof. An example of a suitable filler combination is precipitated calcium carbonate with titanium dioxide. This combination may include from about 0.2 wt % to about 1 wt % (of the total wt % of the uncoated recording medium) of the titanium dioxide, and from about 3 wt % to about 8.8 wt % (of the total wt % of the uncoated recording medium) of the precipitated calcium carbonate. In another example, the combination of precipitated calcium carbonate and titanium dioxide includes from about 5.4 wt % to about 8.8 wt % of the calcium carbonate and from about 0.2 wt % to about 1 wt % of the titanium dioxide. Other example filler combinations include 1:1 kaolin clay and talc.

In the examples disclosed herein, the combination of precipitated calcium carbonate and titanium dioxide may be desirable to achieve, in part, a desirable opacity and a desirable brightness (both of which are discussed further hereinbelow). Many currently available office papers (within or above a traditional weight of 75 gsm) sold in the United States utilize a large amount of calcium carbonate in order to achieve opacity and brightness. As an example, 40 samples of cut sheet office paper sold in the United States were tested for filler content using an X-ray fluorescence analyzer. The filler ranges for each of these papers was found to include less than 1% talc, less than 0.2% clay, from about 13% to about 23% calcium carbonate, and trace amounts (equal to or less than 0.1%) titanium dioxide, where each % is by dry weight of the paper. These results illustrate that traditional weight commercially available papers in the United States rely on calcium carbonate as the filler, likely in part because this particular filler increases paper brightness, and other fillers (such as titanium dioxide) may be more expensive. In light of these results, it seems a thin paper containing calcium carbonate with small amounts of talc and/or clay and trace amounts of titanium dioxide could readily be made. However, a reduced filler amount has been found to deleteriously affect the brightness. This is evidenced by the Askul paper in Example 1, which illustrates that a thin paper containing a reduced amount of calcium carbonate, a small amount of clay, and trace amounts of titanium dioxide does not result in a thin paper with a desirable brightness. In determining a suitable balance between fiber and filler for obtaining a thin paper with desirable stiffness, opacity and brightness, the present inventors have surprisingly found, in an example, that by increasing the amount of titanium dioxide and decreasing the amount of precipitated calcium carbonate, a thin paper with desirable stiffness, opacity, and brightness can be achieved.

Titanium dioxide is commercially available, for example, under the tradename TI-PURE® RPS VANTAGE® (E. I. du Pont de Nemours and Company). Precipitated calcium carbonate may be obtained by calcining crude calcium oxide. Water is added to obtain calcium hydroxide, and then carbon dioxide is passed through the solution to precipitate the desired calcium carbonate. Precipitated calcium carbonate is also commercially available, for example, under the tradenames OPACARB® A40 and ALBACAR® HO DRY (both of which are available from Minerals Technologies Inc.). Ground calcium carbonate is commercially available, for example, under the trade names OMYAFIL®, HYDROCARB 70®, and OMYAPAQUE®, all of which are available from Omya North America. Examples of commercially available filler clays are KAOCAL™, EG-44, and B-80, all of which are available from Thiele Kaolin Company. An example of commercially available talc is FINNTALC™ F03, which is available from Mondo Minerals.

The uncoated recording medium may also include size press (or surface) starch additives, internal starch additives, or internal sizing agents. An example of a suitable size press/surface starch additive is 2-hydroxyethyl starch ether, which is commercially available under the tradename PENFORD® Gum 270 (Penford Products, Co.). When a size press/surface starch additive is included, the amount used may range from about 30 kg/ton of paper to about 50 kg/ton of paper. In an example, the amount of size press/surface starch additive is about 45 kg/ton of paper (i.e., about 100 lbs/ton of paper). An example of a suitable internal starch additive is a cationic potato starch, which is commercially available under the tradename STA-LOK™ 400, from Tate & Lyle. When an internal starch additive is included, the amount used may range from about 3 kg/ton of paper to about 6 kg/ton of paper. In an example, the amount of internal starch additive is about 2.7 kg/ton of paper (i.e., about 6 lbs/ton of paper). Examples of suitable internal sizing agents include alkyl ketene dimer (AKD) and alkenyl succinic anhydride. AKD is commercially available under the tradename HERCON® 80 (Hercules, Inc.), and may be used in an amount ranging from about 1.0 kg/ton of paper to about 3.0 kg/ton of paper. In an example, the amount of AKD included is about 1.8 kg/ton of paper (i.e., about 4 lbs/ton of paper). When alkenyl succinic anhydride is included, the amount used ranges from about 1.0 kg/ton of paper to about 2.5 kg/ton of paper. In an example, the amount of alkenyl succinic anhydride included is about 1.6 kg/ton of paper (i.e., about 3.5 lbs/ton of paper). For the amounts provided herein in terms of per ton of paper, per grams of paper, etc., it is to be understood that the paper refers to the uncoated recording medium.

When it is desirable to utilize the uncoated recording medium for inkjet printing, the medium may also include a salt, which is added during the paper making process at the size press. Examples of suitable salts include calcium chloride ($CaCl_2$), magnesium chloride ($MgCl_2$), aluminum chloride ($AlCl_3$), magnesium sulfate ($MgSO_4$), and combinations thereof. The salt may be added in any amount ranging from about 4000 μg/gram of paper to about 9500 μg/gram of paper. The addition of the salt may provide the uncoated recording medium with the ability to maintain colorants (e.g., present in inkjet inks) at the surface of the uncoated recording medium, thereby improving show through (i.e., strikethrough, or the amount of ink printed on one side of the paper that can be seen through the other side of the paper) as well as other printing qualities (black optical density, color saturation, etc.).

The uncoated recording medium exhibits a number of properties that render the thin paper reliable and suitable for a variety of printing techniques. These properties include stiffness, opacity, ash content, and brightness.

The examples of the uncoated recording medium disclosed herein have a machine direction Lorentezen & Wetter (L&W) 5 degree bending stiffness of at least 0.19 mNm (milliNewton meters). Some examples of the machine direction L&W 5 degree bending stiffness extend up to 0.27 mNm. The examples of the uncoated recording medium disclosed herein have a cross direction Lorentezen & Wetter (L&W) 5 degree bending stiffness ranging from about 0.09 mNm to about 0.12 mNm. L&W stiffness may be measured, for example, using an L&W bending tester available from Lorentezen & Wetter (see http://www.lorentzen-wettre.com/images/stories/LorentzenWettre/PDF_product_info/LW_Bending_Tester_160.pdf). L&W stiffness is generally measured by holding one end of a sample stationary while bending the other end through a selected angle (e.g., ranging from 0° to 5°). The L&W bending tester is automated and performs these steps. The force to bend the sample is measured by the tester. Bending stiffness is also calculated by the tester using the sample size, bending angle, and force. Stiffness may also be measured in terms of Clark stiffness using, for example, a Clark stiffness tester available from Alat Uji. In an example, the Clark stiffness of the uncoated recording medium in the machine direction ranges from about 70 $cm^3/100$ to about 90 $cm^3/100$, and the Clark stiffness of the uncoated recording medium in the cross direction ranges from about 35 $cm^3/100$ to about 40 $cm^3/100$. The stiffness value of the uncoated recording medium provides the thin paper with sufficient rigidity to keep the paper from wrinkling and/or jamming during printing.

The examples of the uncoated recording medium disclosed herein also have an opacity of at least 82. In some instances, the opacity is 83 or 84. For the examples disclosed herein, the maximum opacity may be up to 88. Opacity is an optical property of the paper, and may be determined by a ratio of reflectance measurements. TAPPI opacity (i.e., opacity using 89% reflectance backing) is one opacity value that may be used. TAPPI opacity is 100 times the ratio of reflectance of a sample when backed with a black backing to the reflectance of the sample when backed with a white backing having a known reflectance of 89%. As such, opacity is a unitless property. The reflectance measurements may be carried out using a brightness and color meter. Higher opacity values are often obtained when the amount of filler is increased. However, it has been found in the examples disclosed herein that desirable opacity levels may be achieved with the lower amounts of filler disclosed herein.

The examples of the uncoated recording medium disclosed herein also have an ash content ranging from about 3 wt % to about 10 wt %. The ash content is often equal to the amount of filler. As such, the ash content may also be referred to as a percentage based on the dry weight of the filler used. However, the ash content from burning may be less than the filler level, as determined by room temperature techniques. It is believed that if the ash content is higher, the stiffness may be deleteriously affected, and if the ash content is lower, opacity may be deleteriously affected. In an example, the ash content ranges from about 6 wt % to about 7 wt %.

As mentioned above, the brightness of the uncoated recording medium is also desirable even though the weight of the paper is reduced. Brightness may be increased with an increased amount of filler (e.g., an increased amount of calcium carbonate). However, an increased amount of filler generally decreases the stiffness of the paper. The uncoated recording medium disclosed herein has the reduced amount of filler, desirable brightness, and desirable stiffness. In an example, the desired qualities and the low filler level is achieved using a combination of precipitated calcium carbonate and titanium dioxide in the ranges provided herein. In an example, the ISO brightness of the examples disclosed herein is at least 86 (on a scale of 1-100). In general, ISO 2470 brightness may be measured using illuminant C and 2° observer conditions. It is believed that the ISO brightness may be increased by including calcium carbonate and titanium dioxide in amounts at the higher end of the provided ranges, and/or by adding optical brightening agent(s) to the thin paper. The optical brightening agent(s) may be added in a total amount ranging from about 0.5 kg/ton of paper to about 5 kg/ton of paper. The optical brightening agent may be added in the wet end or in the size press.

In some examples, the uncoated recording medium disclosed herein consists of the fibers and filler(s), with or without the previously mentioned additives, and without any other components that would alter the weight, stiffness, and/or opacity of the uncoated recording medium.

The uncoated recording medium may be made using any suitable paper making process. It is to be understood that the process used does not deposit any coating on the recording medium, rather the various ingredients are processed to form single sheets of thin paper or a continuous web of thin paper. Furthermore, the paper making process used does not form any complexes between the fiber and the filler.

In an example, the uncoated recording medium is formed on a Fourdrinier paper machine. The Fourdrinier paper machine consists of a headbox that delivers a stream of dilute fibers and other papermaking ingredients on to a continuously moving wire belt. The water drains through the wire belt, thereby forming a wet mat of fibers. The mat is then pressed and dried. Subsequent operations may add size press/surface additives to improve strength and a calendering step may be used to smooth the paper. In another example, the mat can be formed between two wires using a twin wire paper machine. Paper made by a continuous process, such as Fourdrinier or twin wire paper machines, has directionality. The Machine Direction (MD) of the paper refers to the direction the wire travels. The Cross Direction (CD) of the paper refers to the direction perpendicular to the direction the wire travels. Some physical properties of the paper, such as stiffness (as noted above and in at least some of the examples below), will have different values in the MD versus CD.

As noted above, the examples of the thin paper disclosed herein may be printed using a variety of printing techniques, including laser printing and inkjet printing. Printing may be accomplished in the typical manner, where the thin paper is fed into the selected printer, and toner or ink is applied thereto. When printing on thin paper, it is to be understood that a printing mode that utilizes less energy may be used. For example, some laser (i.e., laser jet, enterprise) printers are capable of detecting the thin paper and automatically initiating an energy savings printing mode that uses a lower temperature for fusing than a printing mode used for higher weight paper. While the thin paper is actually being printed on in the energy savings printing mode, the overall energy savings may range from about 4% to about 6%.

To further illustrate the present disclosure, examples are given herein. It is to be understood that these examples are provided for illustrative purposes and are not to be construed as limiting the scope of the present disclosure.

EXAMPLES

Example 1

Commercially available papers were tested. These commercially available papers included Askul 60 gsm Paper (available in Japan), Mondi's Maestro, International Paper's 60 Standard bond, and Boise Cascade's X-9.

In the following discussion, the ash content of the commercially available papers was determined using TAPPI test method T 211. A test specimen was ignited in a muffle furnace at 525° C. to burn off organic fibers. A separate test specimen was analyzed for the percentage moisture. The resulting weight of ash and moisture level in the sample are used to calculate the percentage ash present at 525° C. on a moisture-free sample basis.

The Clark stiffness of the commercially available paper was also determined using TAPPI Standard T541. Stiffness was also measured using a Lorentezen & Wetter (L&W) bending-resistance tester both in the machine direction and in the cross direction. L&W stiffness was measured by holding one end of a sample stationary while and bending the other end through an angle (e.g., ranging from 0° to 5°). The force to bend the sample was measured. Bending stiffness was calculated by the tester using the sample size, bending angle, and force.

The commercially available papers were tested for brightness. The Tappi brightness was measured using TAPPI Standard T452, "Brightness of pulp, paper, and paperboard (directional reflectance at 457 nm)". ISO 2470 brightness was measured using illuminant C and 2° observer conditions.

Opacity was tested using TAPPI test method T425. In accordance with this test method, a reflectance measurement was made on a sheet of paper backed by a black backing, $R_0$. Another reflectance measurement was made on the sheet backed by an 89% reflective tile, $R_{0.89}$. Opacity=$100\times R_0/R_{0.89}$. Higher opacity values indicate that it is more difficult to see through the sheet of paper.

A hot mandrel (bend) test was also performed for some of the commercially available papers. This test involved contacting strips of each paper with a hot mandrel (i.e., a heated surface that had a radius of curvature of about 8 inches). The heated surface was made from a block of aluminum, and the curvature of the surface ensured good contact with the respective paper samples. The mandrel was heated to 150° C. using a hot plate. This laboratory test is often predictive of curl resulting for a laser printer fuser, but is independent of the geometric variables present in a fuser.

For the hot mandrel test, paper strips of 1 inch by 8 inches were cut from the respective sheets of paper. Four strips were cut, namely two strips with the 8 inch direction in the machine direction, and two strips with the 8 inch direction in the cross direction. Each strip was held in contact with the hot surface for three seconds. Curl was immediately measured using a hanging curl chart as described in ASTM standard D4825 and results were recorded in millimeters. The final results for a single sheet include four values, representing a MD strip and CD strip heated on side 1, and a MD strip and CD strip heated on side 2.

Desirable hot mandrel test results include similar results for curl when heating side 1 compared to heating side 2. This indicates uniformity in the paper sheet. The value in millimeters of MD side 1 minus MD side 2, and similar for CD strips, is a simple way to characterize a paper curl, with low numbers often predicting low curl in laser printers. These values are reported in this Example.

Askul 60 gsm Paper (Askul Paper)

The Askul paper included the following fillers: 0.4 wt % clay, 5.2 wt % calcium carbonate, and a trace amount (equal to or less than 0.1 wt %) $TiO_2$. The Askul paper included about 93 wt % fiber. The basis weight was 60.4.

The Tappi brightness and ISO brightness, opacity, ash content, and stiffness were determined for the Askul paper. The Tappi brightness was 84. The ISO brightness on the seam-up side was 81% and the brightness on the seam-down side was 81%. The ISO brightness is fairly low, based on the USA standard of 93. With this low ISO brightness value, the contrast between paper and printing is lower, making any printed text or color look less bright. The opacity was 82. The ash content, measured at 525° C., was about 6.7 wt %. The Clark stiffness ($cm^3/100$) was 87.4 in machine direction and 39.1 in cross direction. The L&W stiffness was 0.22 in machine direction and 0.10 in cross direction.

The Askul paper was tested using a laser jet printer. In terms of feedability, fixing, transfer, curl, wrinkle, and stacking, the Askul paper performed marginal to very good. In particular, the Askul paper printed on the laser jet printer was marginal in terms of feedability and curl.

Curl was also tested using the hot mandrel (bend) test, as described above. The machine direction axis (MD) curl for Askul paper was 20 (average for 12 sheets with a standard deviation of 13) and the cross direction axis curl for Askul paper was 13 (average for 12 sheets with a standard deviation of 6). While these results are marginal, values of 10 or lower are more desirable. The hot mandrel (bend) test was indicative of the post printer curl that was actually exhibited by the Askul paper.

Mondi's Maestro (Maestro)

The Maestro included 10.4 wt % calcium carbonate as the filler. The basis weight was 61.6. Maestro included about 89 wt % fiber.

The Tappi brightness and ISO brightness, opacity, ash content, and stiffness were determined for the Maestro. The Tappi brightness was 94. The ISO brightness on the seam-up side was 101% and the brightness on the seam-down side was 101%. The opacity was 84. The ash content, measured at 525° C., was about 16.7 wt %. The Clark stiffness ($cm^3/100$) was 70.8 in machine direction and 40.2 in cross direction. The L&W stiffness was 0.20 in machine direction and 0.10 in cross direction.

The Maestro was also tested using a laser jet printer. In terms of feedability, fixing, transfer, curl, wrinkle, and stacking, the Maestro performed marginal to very good. In particular, the Maestro printed on the laser jet printer was marginal in terms of curl.

Curl was also tested using the hot mandrel (bend) test as previously described. The machine direction axis curl for Maestro was 8 (average for 12 sheets with a standard deviation of 13) and the cross direction axis curl for Maestro was 3 (average for 12 sheets with a standard deviation of 7). While the hot mandrel (bend) test indicated that curl would be minimal, an undesirable amount of post printer curl was actually exhibited by the Maestro sample. It is believed that the poor curl performance was due, at least in part, to the relatively high filler amount and ash content.

International Paper's 60 Standard Bond (IP60)

The IP60 included calcium carbonate as a filler in an amount of 14.2 wt %. It was estimated that IP60 included about 86 wt % fiber. The basis weight was 60.9 gsm.

The ISO brightness, ash content, and stiffness were determined for the IP 60. The ISO brightness on the seam-up side was 96% and the brightness on the seam-down side was 97%. The ash content, measured at 525° C., was about 15 wt %. The Clark stiffness ($cm^3/100$) was 58.8 in machine direction and 30.5 in cross direction. The L&W stiffness was 0.15 in machine direction and 0.08 in cross direction.

The IP60 was tested using a laser jet printer. In terms of feedability, fixing, transfer, curl, wrinkle, and stacking, the IP 60 performed relatively poorly. In particular, the IP60 suffered from feedability issues, curl issues, wrinkling issues, and stacking issues. It is believed that the poor printing performance was due, at least in part, to the relatively low stiffness value and the relatively high filler amount and ash content.

Boise Cascade's X-9 (X-9)

The X-9 included the following fillers: 0.4 wt % talc, 0.3 wt % clay, 0.3 wt % $SiO_2$, and 13.3 wt % calcium carbonate. The basis weight was 61.8. X-9 included about 85 wt % fiber.

The Tappi brightness and ISO brightness, opacity, ash content, and stiffness were determined for the X-9. The Tappi brightness was 94. The ISO brightness on the seam-up side was 94% and the brightness on the seam-down side was 94%. The opacity was 87. The ash content, measured at 525° C., was about 16.9 wt %. The Clark stiffness ($cm^3$/100) was 87.4 in machine direction and 38.0 in cross direction. The L&W stiffness was 0.22 in machine direction and 0.12 in cross direction.

The X-9 was also tested using a laser jet printer. In terms of curl, wrinkle, and stacking, the X-9 performed poorly.

Curl was again tested using a hot mandrel (bend) test, as described above. The machine direction axis curl for X-9 was 16 (average for 12 sheets with a standard deviation of 27) and the cross direction axis curl for X-9 was 26 (average for 12 sheets with a standard deviation of 16). For X-9, it was noted that the curl performance for three of the sheets were very different from the other nine sheets, thus the large standard deviation. It is believed that the poor printing performance was due, in part, to the high variability in curl from sheet to sheet. It is also believed that the poor printing performance was due, at least in part, to the relatively high filler amount and ash content.

The test results for the commercially available papers illustrate that when higher levels are filler are utilized, stiffness and/or printing performance are deleteriously affected. The results also indicate that when lower levels of particular fillers are utilized, other properties, such as brightness, may be deleteriously affected.

Example 2

12 paper samples were generated according to the specifications outlined in Table 1. Each of these paper samples included a hardwood (HW)/softwood (SW) fiber blend (International Paper northern USA HW and International Paper southern USA SW), precipitated calcium carbonate (ALBACAR® HO DRY), and titanium dioxide (TI-PURE® RPS VANTAGE®). While all of the sample measurements indicated that some level of calcium chloride was present, samples 4-9 intentionally had the salt added thereto. Each of samples 1 through 12 also included 1.8 kg of AKD per ton of paper, 2.7 kg of STA-LOK™ 400 per ton of paper, and 43 kg of PENFORD® Gum 270 per ton of paper. The fiber blend was added in amounts so that the final wt % of each sample was 100 wt %.

The basis weight reported in Table 1 is an average of two measurements that were taken of the samples at different times. The basis weight shown in Table 1 may be adjusted down so that the basis weight is closer to 60 gsm while still meeting the desired minimum stiffness disclosed herein. The basis weight may be adjusted, for example, by adjusting the amounts of fiber, filler and other ingredients flowing from the Fourdrinier headbox.

TABLE 1

| Sample | HW/SW | $CaCO_3$ (wt %) | $TiO_2$ (wt %) | $CaCl_2$ (μg/g paper) | Basis Weight (gsm) |
|---|---|---|---|---|---|
| 1 | 70/30 | 2.87 | 0.28 | 97 | 66.5 |
| 2 | 70/30 | 5.49 | 0.29 | 245 | 67.6 |

TABLE 1-continued

| Sample | HW/SW | $CaCO_3$ (wt %) | $TiO_2$ (wt %) | $CaCl_2$ (μg/g paper) | Basis Weight (gsm) |
|---|---|---|---|---|---|
| 3 | 70/30 | 8.80 | 0.40 | 272 | 61.9 |
| 4 | 70/30 | 8.21 | 0.75 | 7704 | 64.0 |
| 5 | 70/30 | 5.45 | 0.75 | 7347 | 61.6 |
| 6 | 70/30 | 3.50 | 0.77 | 7457 | 62.7 |
| 7 | 60/40 | 3.08 | 0.64 | 5086 | 70.3 |
| 8 | 60/40 | 6.07 | 0.62 | 5417 | 63.7 |
| 9 | 60/40 | 8.66 | 0.52 | 6269 | 68.7 |
| 10 | 60/40 | 3.11 | 0.71 | 18 | 62.9 |
| 11 | 60/40 | 6.04 | 0.51 | 82 | 67.8 |
| 12 | 60/40 | 9.59 | 0.51 | 54 | 68.4 |

Each of samples 1 through 12 was tested for opacity. The opacity results are set forth in Table 2.

TABLE 2

| Sample | Opacity |
|---|---|
| 1 | 80 |
| 2 | 82 |
| 3 | 83 |
| 4 | 85 |
| 5 | 82 |
| 6 | 80 |
| 7 | 80 |
| 8 | 83 |
| 9 | 84 |
| 10 | 79 |
| 11 | 83 |
| 12 | 85 |

The opacity versus the percentage of filler used is shown in FIG. 1. As illustrated in FIG. 1, as the total filler percentage is increased, the opacity increased.

The Tappi brightness and the ISO brightness of each of the samples 1 through 12 were also measured as described above in Example 1. These results are shown in Table 3.

TABLE 3

| Sample | Tappi Brightness | ISO Brightness |
|---|---|---|
| 1 | 83 | 85 |
| 2 | 85 | 86 |
| 3 | 86 | 87 |
| 4 | 86 | 87 |
| 5 | 85 | 87 |
| 6 | 84 | 86 |
| 7 | 85 | 87 |
| 8 | 86 | 87 |
| 9 | 87 | 88 |
| 10 | 85 | 87 |
| 11 | 86 | 87 |
| 12 | 86 | 88 |

The desirable ISO brightness is at least 86, which samples 2-12 exhibited.

Inkjet inks were printed on each of the sample papers 1 through 12. Black and red inks were printed onto each of the papers using an HP Officejet Pro 8100. The black printed ink was tested for optical density (KOD), the red printed ink was tested for red saturation, and the prints were also tested for strikethrough. KOD is a logarithmic function of the reflectance from a black surface. The darker, lower reflectance, the image, the higher the KOD value. KOD of the test plots were measured using an XRite 939 spectrodensitometer set to Status T. The red saturation (a measure of color richness) is calculated from L, a, b color readings of red solid fill area (100% M+100% Y). Color measurements were made with the XRite 939. The reported red saturation values are the color space volume in L, a, b color values. A higher value for red saturation indicates better color richness. Strikethrough was test using the XRite 938 set to reflectance with Illuminate A/2 degrees. A simplex printed test plot with a black solid area was placed print side down on a white backing. Reflectance readings were taken on the back side of the paper in an area with no printing and in the area with solid printing. Strikethrough is calculated as the reduction in reflectance, normalized to the paper reflectance, $(1-(R_{solid\ area}/R_{paper}))\times 100$. A lower strikethrough value indicates less image seen through the paper and therefore, better duplex print quality. The results from these tests are shown in Table 4.

TABLE 4

| Sample | Black Optical Density (KOD) | Red Saturation | Strikethrough (%) |
|---|---|---|---|
| 1 | 1.12 | 0.87 | 29 |
| 2 | 1.09 | 0.88 | 27 |
| 3 | 1.18 | 0.87 | 22 |
| 4 | 1.38 | 1.04 | 15 |
| 5 | 1.42 | 1.04 | 18 |
| 6 | 1.29 | 1.04 | 18 |
| 7 | 1.32 | 0.99 | 25 |
| 8 | 1.40 | 0.99 | 19 |
| 9 | 1.36 | 1.04 | 19 |
| 10 | 1.17 | 0.87 | 28 |
| 11 | 1.13 | 0.87 | 30 |
| 12 | 1.10 | 0.87 | 26 |

Figure 2:
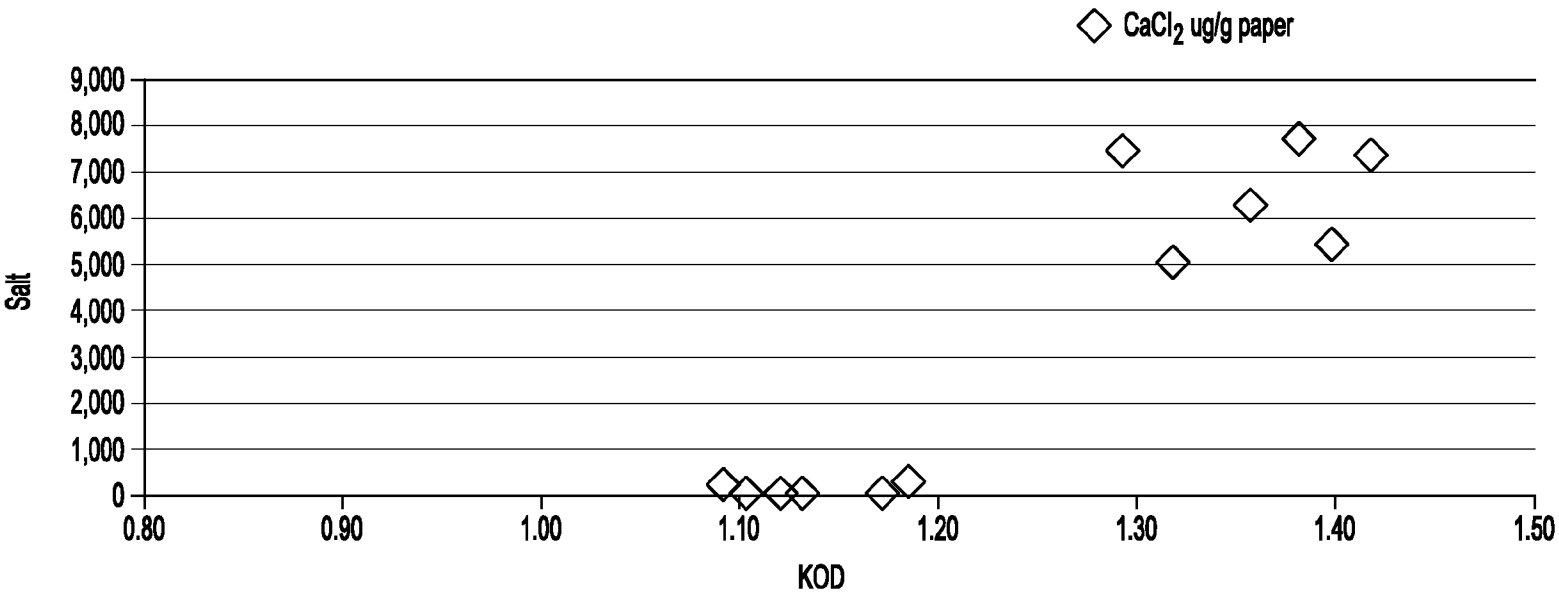
FIG. 2 is a graph illustrating black optical density versus the amount of calcium chloride for samples 1 through 12 of Example 2.

FIG. 2 illustrates the effect that the added calcium chloride had on the black optical density. For samples 1 through 3 and 10 through 12, which did not have calcium chloride added thereto, the black optical density of the printed ink was between about 1 and 1.2. However, the black optical density increased for those samples having added calcium chloride. More particularly, samples 4 through 9 had an optical density ranging from 1.29 to 1.42.

Figure 3:
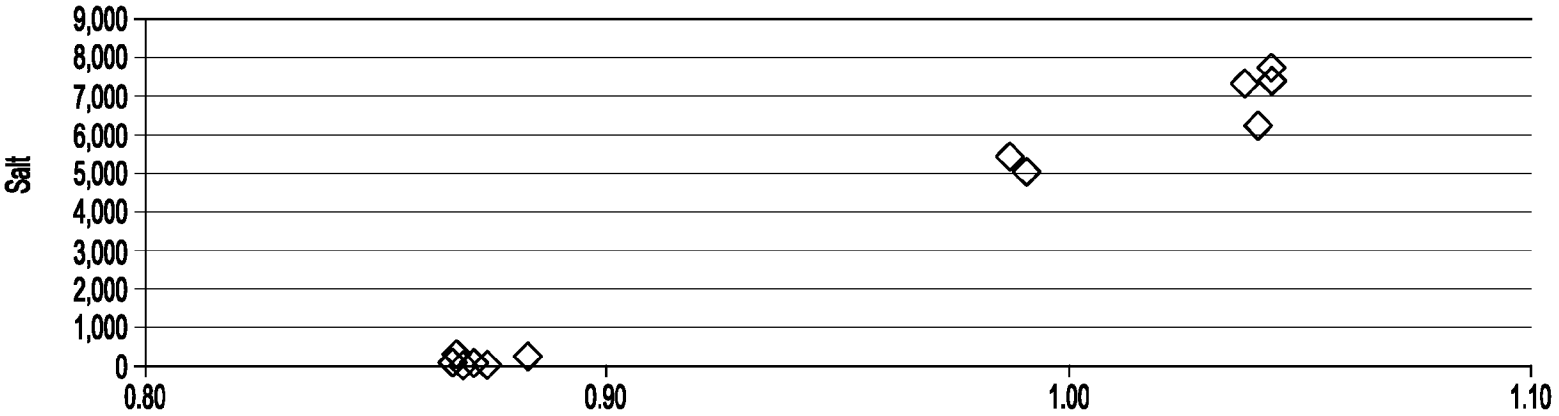
FIG. 3 is a graph illustrating red saturation versus the amount of calcium chloride for samples 1 through 12 of Example 2.

FIG. 3 illustrates the effect that the added calcium chloride had on red saturation. Similar to black optical density, red saturation increased for the samples having calcium chloride added thereto. In particular, samples 1 through 3 and 10 through 12 had red saturation ranging from 0.87 to 0.88, while samples 4 through 9 had red saturation ranging from 0.99 to 1.04.

Figure 4:
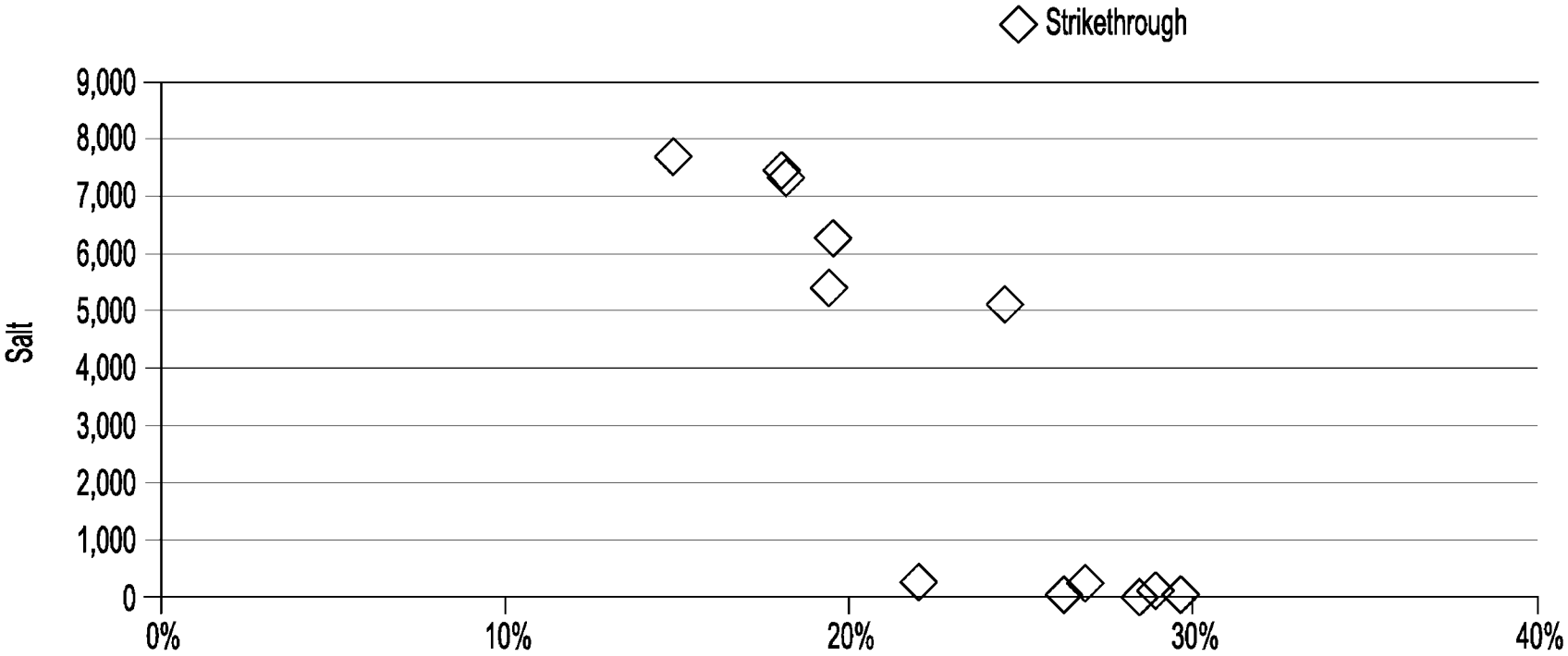
FIG. 4 is a graph illustrating strikethrough for samples 1 through 12 of Example 2.

FIG. 4 illustrates the effect that the added calcium chloride had on strikethrough of the ink printed on samples 1 through 12. Strikethrough is indicative of the amount of ink that is seen through the paper after the image is printed thereon. The measurement is a loss of reflectance, and a lower percentage value is indicative of less strikethrough. As shown in FIG. 4, samples 4 through 6, 8 and 9 exhibited a loss of reflectance less than 20%. Sample 7, which had the smallest amount of calcium chloride added thereto, illustrated a loss of reflectance of about 25%. It is believed that this result may be due to the relatively small amount of calcium chloride that was added, when compared to the amounts added to samples 4 through 6, 8 and 9. Each of the samples that did not have calcium chloride added thereto (e.g., samples 1 through 3 and 10 through 12) has loss of reflectance values at or above 22%.

The print quality results shown in Table 4 and FIGS. 2 through 4 illustrate that adding calcium chloride to the samples rendered the papers more suitable for inkjet printing.

Example 3

Inkjet inks were printed on sample papers 3 (no salt added) and 4 (salt added) from Example 2, on HP Multipurpose paper which includes a salt therein (75 gsm, referred to as HPMP), on Boise Cascade's X-9 (no salt added), and on Askul 60 gsm Paper (no salt added). Black and red inks were printed onto each of the papers using an HP Officejet Pro 8100. The black printed ink was tested for optical density (KOD), the red printed ink was tested for red saturation, and the prints were also tested for strikethrough. It is noted that sample papers 3 and 4, HPMP, and X-9 were tested twice, and the average results are reported herein. The Askul 60 gsm Paper was tested once. The results are reported in Table 5.

TABLE 5

| Sample | Black Optical Density (KOD) | Red Saturation | Strikethrough (%) |
|---|---|---|---|
| 3 | 1.20 | 0.86 | 22 |
| 4 | 1.40 | 1.03 | 15 |
| HPMP | 1.38 | 1.09 | 12 |
| X-9 | 1.22 | 0.83 | 21 |
| Askul | 1.35 | 0.94 | 25 |

Sample 4 (with added salt) and HPMP both exhibited particularly desirable results for KOD, red saturation, and strikethrough. Consistent with the results given in Table 5, sample 3 (having no salt added thereto) exhibited less than desirable KOD and red saturation, and relatively high strikethrough. X-9 also exhibited less than desirable KOD and red saturation, and marginally high strikethrough. While Askul had desirable KOD, the red saturation was low and strikethrough was high. These results illustrate that papers including salt are more suitable for inkjet printing.

It is to be understood that the ranges provided herein include the stated range and any value or sub-range within the stated range. For example, a range from about 3 wt % to about 10.2 wt % should be interpreted to include not only the explicitly recited limits of about 3 wt % to about 10.2 wt %, but also to include individual values, such as 3.7 wt %, 5 wt %, 9 wt %, etc., and sub-ranges, such as from about 3.5 wt % to about 9.5 wt %, from about 4 wt % to about 6 wt %, etc. Furthermore, when "about" is utilized to describe a value, this is meant to encompass minor variations (up to +/−10%) from the stated value.

While several examples have been described in detail, it will be apparent to those skilled in the art that the disclosed examples may be modified. Therefore, the foregoing description is to be considered non-limiting.

What is claimed is:

1. An uncoated recording medium, comprising:

a blend of hardwood fibers and softwood fibers, wherein a total fiber content is at least 80 wt % of a total wt % of the uncoated recording medium; and a filler present in an amount ranging from about 3 wt % to about 10.2 wt % of the total wt % of the uncoated recording medium;

the uncoated recording medium having i) a weight ranging from about 50 g/m$^2$ to about 70 g/m$^2$, ii) a machine direction Lorentezen & Wetter 5 degree bending stiffness ranging from about 0.19 mNm to about 0.27 mNM and a cross direction Lorentezen & Wetter 5 degree bending stiffness ranging from about 0.09 mNm to about 0.12 mNm, and iii) an ISO brightness of at least 86.

2. The uncoated recording medium as defined in claim 1, further comprising a salt present in an amount ranging from about 4000 μg per gram of the uncoated recording medium to about 9500 μg per gram of the uncoated recording medium.

3. The uncoated recording medium as defined in claim 1 wherein the uncoated recording medium further has an opacity of at least 82.

4. The uncoated recording medium as defined in claim 1 wherein the filler is chosen from titanium dioxide, precipitated calcium carbonate, ground calcium carbonate, talc, clay, and combinations thereof.

5. The uncoated recording medium as defined in claim 4 wherein:

the filler includes a combination of the titanium dioxide and the precipitated calcium carbonate;

an amount of the titanium dioxide ranges from 0.2 wt % to about 1 wt % of the total wt % of the uncoated recording medium; and an amount of the precipitated calcium carbonate ranges from about 3 wt % to about 8.8 wt % of the total wt % of the uncoated recording medium.

6. The uncoated recording medium as defined in claim 1 wherein the blend includes a ratio of the hardwood fibers to the softwood fibers ranging from about 70/30 to about 60/40.

7. The uncoated recording medium as defined in claim 1, further comprising a size press starch additive, an internal starch additive, and any of alkyl ketene dimer or alkenyl succinic anhydride.

8. The uncoated recording medium as defined in claim 1 wherein the uncoated recording medium excludes expanded fibers.

9. The uncoated recording medium as defined in claim 1 wherein the uncoated recording medium has an ash content ranging from about 3 wt % to about 9% of the total wt % of the uncoated recording medium.

10. The uncoated recording medium as defined in claim 1 wherein:

i) the blend of hardwood fibers and softwood fibers includes chemically pulped hardwood fibers and chemically pulped softwood fibers; or ii) at least 90 wt % of the total fiber content includes chemically pulped hardwood fibers and chemically pulped softwood fibers, and up to 10 wt % of the total fiber content includes mechanically pulped hardwood fibers and mechanically pulped softwood fibers.

11. A printing method for the uncoated recoding medium as defined in claim 1, the method comprising one of:

i) inkjet printing an ink on the uncoated recording medium; or ii) applying a toner to the uncoated recording medium; and fusing the toner utilizing an energy savings printing mode.

12. An uncoated recording medium, comprising:

a blend of hardwood fibers and softwood fibers, wherein a total fiber content is at least 80 wt % of a total wt % of the uncoated recording medium;

a filler present in an amount ranging from about 3 wt % to about 10.2 wt % of the total wt % of the uncoated recording medium; and a salt present in an amount ranging from about 4000 μg per gram of the uncoated recording medium to about 9500 μg per gram of the uncoated recording medium.

13. A printing method for the uncoated recoding medium as defined in claim 12, the method comprising;

inkjet printing an ink onto a surface of the uncoated recording medium.

14. A method, comprising:

selecting an amount of a fiber blend and an amount of a filler to achieve an uncoated recording medium having i) a weight ranging from about 50 $g/m^2$ to about 70 $g/m^2$, ii) a machine direction Lorentezen & Wetter 5 degree bending stiffness of at least 0.14 mNm and a cross direction Lorentezen & Wetter 5 degree bending stiffness ranging from about 0.09 mNm to about 0.12 mNm, iii) an ISO brightness of at least 86, and iv) an opacity of at least 82.

15. The method as defined in claim 14 wherein:

the selecting of the amount of the fiber blend includes selecting at least 80 wt % of a total wt % of the uncoated recording medium to include a ratio of hardwood fibers to softwood fibers that ranges from about 70/30 to about 60/40; and the selecting of the amount of the filler includes selecting from about 3 wt % to about 10.2 wt % of the total wt % of the uncoated recording medium to include the filler chosen from titanium dioxide, precipitated calcium carbonate, ground calcium carbonate, talc, clay, and combinations thereof.

16. The method as defined in claim 15 wherein the selecting of the amount of filler includes:

selecting the titanium dioxide to make up from about 0.2 wt % to about 1 wt % of the total wt % of the uncoated recording medium; and selecting the precipitated calcium carbonate to make up from about 3 wt % to about 8.8 wt % of the total wt % of the uncoated recording medium.

17. The method as defined in claim 14, further comprising:

exposing the fiber blend and the filler to a papermaking process to form the uncoated recording medium; and adding a salt during the papermaking process at a size press.

* * * * *